US009987759B2

(12) United States Patent
Molema et al.

(10) Patent No.: US 9,987,759 B2
(45) Date of Patent: Jun. 5, 2018

(54) MOUNTING UNIT AND HAIR CUTTING APPLIANCE

(71) Applicant: KONINKLIJKE PHILIPS N.V., Eindhoven (NL)

(72) Inventors: Jeroen Molema, Eindhoven (NL); Albert Jan Aitink, Eindhoven (NL); Bram Tuijp, Eindhoven (NL); Hendrik Klaas Louwsma, Eindhoven (NL); Martinus Bernardus Stapelbroek, Eindhoven (NL); Robbert Freerk Johan Van Der Scheer, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days. days.

(21) Appl. No.: 15/036,086

(22) PCT Filed: Nov. 21, 2014

(86) PCT No.: PCT/EP2014/075220

§ 371 (c)(1),
(2) Date: May 12, 2016

(87) PCT Pub. No.: WO2015/075160

PCT Pub. Date: May 28, 2015

(65) Prior Publication Data

US 2016/0271815 A1 Sep. 22, 2016

(30) Foreign Application Priority Data

Nov. 22, 2013 (EP) ..... 13193974

(51) Int. Cl.

| | |
|---|---|
| ***B26B 19/38*** | (2006.01) |
| ***B26B 19/04*** | (2006.01) |
| ***B26B 21/22*** | (2006.01) |

(52) U.S. Cl.
CPC ..... *B26B 19/3846* (2013.01); *B26B 19/048* (2013.01); *B26B 21/225* (2013.01)

(58) Field of Classification Search
CPC . B26B 19/386; B26B 19/042; B26B 19/3846; B26B 19/048; B26B 21/225
See application file for complete search history.

(56) References Cited

U.S. PATENT DOCUMENTS 2,102,529 A * 12/1937 Hanley ..... B26B 19/042 30/346.51
2,151,965 A 3/1939 Hanley
(Continued)

FOREIGN PATENT DOCUMENTS

EP 0267044 A1 5/1988
EP 1547735 A1 6/2005
(Continued)

*Primary Examiner* — Hwei C Payer

(57) ABSTRACT

A hair cutting appliance includes a mounting unit configured to couple a cutting unit to a housing. The mounting unit includes a swivel mechanism having a base portion configured to be coupled to the housing, and a top portion configured to be coupled to the cutting unit, where the base and top portions are movable with respect to each other, such that, during operation, the cutting unit is pivotably supported by the swivel mechanism, which defines a virtual pivot axis for the cutting unit. The virtual pivot axis is substantially parallel to a cutting edge of the cutting unit. In a first or shaving state of the swivel mechanism, the virtual pivot axis is located at a first position with respect to the cutting unit, and in a second or styling state, the virtual pivot axis is located at a second position that is different from the first position.

18 Claims, 7 Drawing Sheets

(56) References Cited

U.S. PATENT DOCUMENTS

| | | | | | |
|---|---|---|---|---|---|
| 2,290,326 | A | | 7/1942 | Hanley | |
| 4,797,997 | A | * | 1/1989 | Packham | B26B 19/046 30/43.1 |
| 5,611,145 | A | * | 3/1997 | Wetzel | B26B 19/044 30/43.92 |
| 5,661,907 | A | | 9/1997 | Apprille, Jr. | |
| 5,704,126 | A | * | 1/1998 | Franke | B26B 19/046 30/34.1 |
| 5,787,593 | A | * | 8/1998 | Althaus | B26B 21/225 30/527 |
| 5,802,932 | A | | 9/1998 | Vankov | |
| 6,308,416 | B1 | * | 10/2001 | Bosy | B26B 21/225 30/50 |
| 7,137,205 | B2 | * | 11/2006 | Royle | B26B 21/225 30/50 |
| 7,162,801 | B2 | * | 1/2007 | Royle | B26B 19/048 30/43.92 |
| 7,841,090 | B2 | * | 11/2010 | Eichhorn | B26B 19/048 30/346.51 |
| 8,347,508 | B2 | * | 1/2013 | Shimizu | B26B 19/048 30/45 |
| 9,399,302 | B2 | * | 7/2016 | Shimizu | B26B 19/048 |
| 2002/0011683 | A1 | | 1/2002 | Gadaree | |
| 2011/0094107 | A1 | | 4/2011 | Ring | |
| 2013/0160306 | A1 | | 6/2013 | Howell | |
| 2016/0271815 | A1 | * | 9/2016 | Molema | B26B 19/048 |
| 2016/0288348 | A1 | * | 10/2016 | Molema | B26B 19/042 |
| 2017/0120466 | A1 | * | 5/2017 | Phoon | B26B 19/28 |

FOREIGN PATENT DOCUMENTS

| | | | | |
|---|---|---|---|---|
| EP | 1621299 | A1 | | 2/2006 |
| WO | 0038893 | A2 | | 7/2000 |
| WO | 2010000352 | A2 | | 1/2010 |
| WO | 2013095949 | A1 | | 6/2013 |
| WO | 2013150412 | A1 | | 10/2013 |
| WO | 2015074882 | A1 | | 5/2015 |
| WO | WO 2015/075160 | A1 | * | 5/2015 |

* cited by examiner

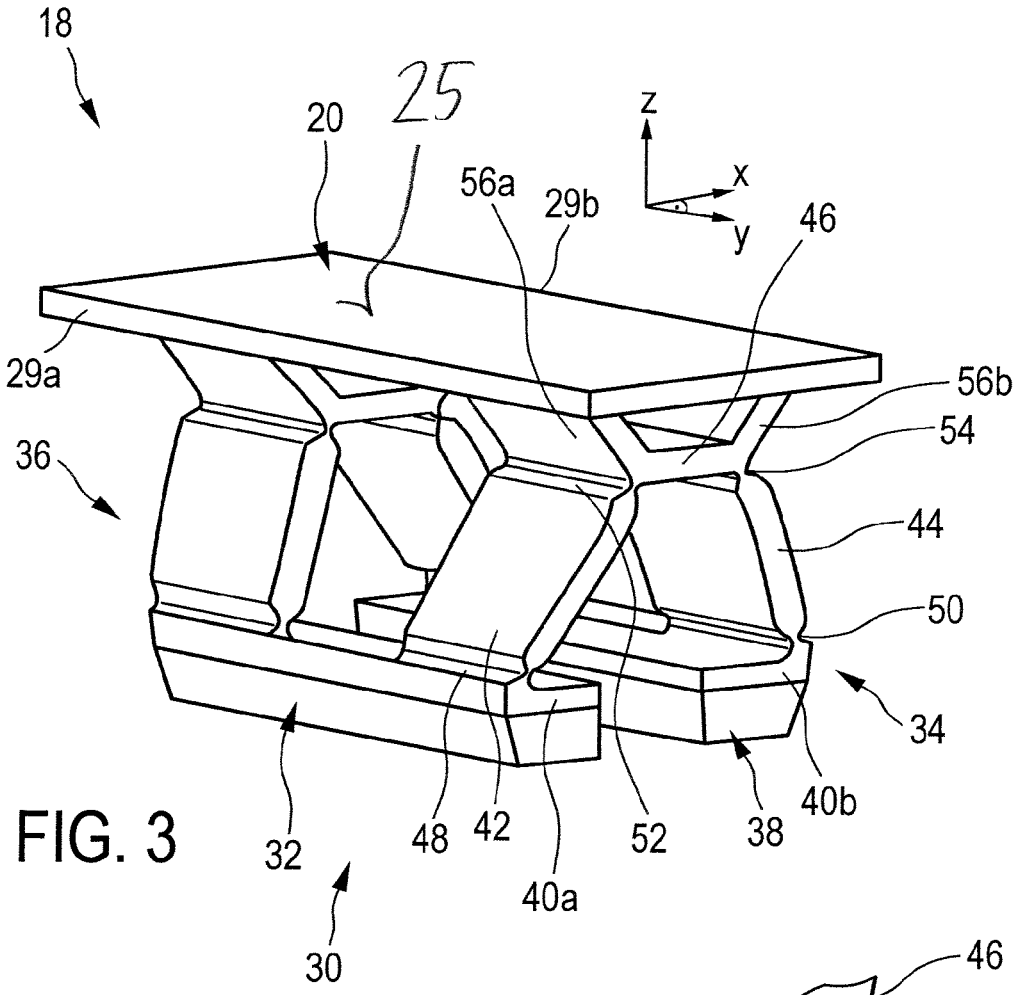
FIG. 3
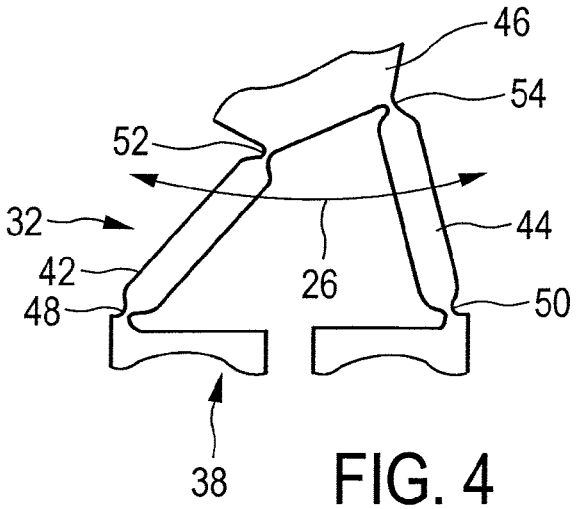
FIG. 4
FIG. 5
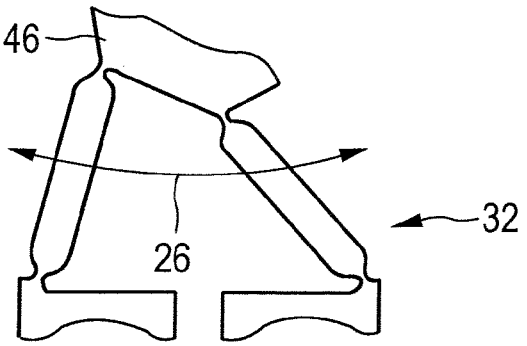

MOUNTING UNIT AND HAIR CUTTING APPLIANCE

This application is the U.S. National Phase application under 35 U.S.C. § 371 of International Application No. PCT/EP2014/075220, filed on Nov. 21, 2014, which claims the benefit of International Application No. 13193974.6 filed on Nov. 22, 2013. These applications are hereby incorporated by reference herein.

FIELD OF THE INVENTION

The present disclosure relates to a hair cutting appliance, particularly to an electrically operated hair cutting appliance and more particularly to a mounting unit for coupling a cutting unit and a housing of a hair cutting appliance. The cutting unit may comprise a blade set, and may be arranged to be moved through hair in a moving direction to cut hair. The blade set may comprise a stationary blade and a movable blade, wherein the movable blade may be moved with respect to the stationary blade so as to cut hair trapped there between.

BACKGROUND OF THE INVENTION

EP 1 621 299 A1 discloses a dry shaver comprising a grip to be grasped by a user's hand, a shaving head being supported to said grip and carrying a foil cutter unit composed of an outer foil and an inner cutter driven to move relative to said outer foil in hair shearing engagement therewith, wherein said outer foil is elongated to have a length and a width, and being arcuately curved along its length, and wherein said shaving head is movably supported to said grip so as to be tiltable about a transverse axis parallel to the width of said outer foil.

EP 1 547 735 A1 discloses a dry shaver comprising a grip having a height axis, a shaving head mounted on top of said grip with respect to a height axis of said grip, said shaving head having a cutting face on its top and having a pair of support points through which said shaving head is supported to said grip, and a linkage mechanism which couples said shaving head to said grip for allowing said shaving head to swing relative to said grip, wherein said linkage mechanism includes a pair of cranks each connected at its one end to each one of said support points and connected at the other end to each one of anchor points on the side of said grip, and wherein a frame projects on top of said grip in an overlapping relation with said shaving head.

WO 2013/150412 A1 discloses a hair cutting appliance and a corresponding blade set of a hair cutting appliance. The blade set comprises a stationary blade and a movable blade, wherein the movable blade can be reciprocatingly driven with respect to the stationary blade for cutting hair. The blade set is particularly suited for enabling both trimming and shaving operations.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes generally two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both, shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Unfortunately, common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small circular perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that often prevents hair from being cut off close to the skin. Consequently, a user desiring to both shave and trim his body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

The above WO 2013/150412 A1 tackles this issue by providing for a blade set comprising a stationary blade that houses the movable blade such that a first portion of the stationary blade is arranged at the side of the movable blade facing the skin when in use in use, and that a second portion of the stationary blade is arranged at the side of the movable blade facing away from the skin when in use for shaving. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge, including respective teeth alternating with slots, also allows for longer hairs to enter the slots and, consequently, to be cut by the relative cutting motion between the movable blade and the stationary blade.

SUMMARY OF THE INVENTION

The cutting appliance known from WO 2013/150412 A1 is particularly suited for both trimming and shaving operations but does not address shaving performance peculiarities and practical use aspects for hair cutting operations. For instance, when shaving facial hair, account should be taken of the basically uneven contour of the skin surface. For optimizing the shaving performance, the blade set should be guided at a predefined angle with respect to the current skin portion. This may complicate the handling of such a hair cutting appliance. Moreover, it has been observed that several users apply shaving devices also for styling operations, e.g. for precisely shaping an actual beard form or sideburns which may pose a further challenge.

It is an object of the present disclosure to provide for a hair cutting appliance, particularly for a mounting unit for a cutting unit thereof, that is suited for a wide range of applications, and that particularly exhibits improved daily-use suitability. Preferably, the mounting unit, and a hair cutting appliance fitted with the mounting unit, is capable of performing both shaving and precise styling operations. More preferably, a hair cutting appliance fitted with the mounting unit may be particularly easy to operate. More particularly, handling the hair cutting appliance during use shall be improved. Advantageously the mounting unit may simplify contour following when shaving hair at the level of the skin while also allowing for precise styling operations. More preferably, it would be advantageous to provide for a mounting unit that can be produced with minor effort. The invention is defined by the independent claims; the dependent claims define advantageous embodiments.

In a first aspect of the present disclosure a mounting unit for coupling a cutting unit and a housing of a hair cutting appliance is presented, said mounting unit comprising:

a swivel mechanism comprising a base portion arranged to be coupled to a housing, and a top portion arranged to be coupled to a cutting unit, wherein the base portion and the top portion are movable with respect to each other, such that, during operation, the cutting unit is pivotably supported by the swivel mechanism, wherein the swivel mechanism defines a virtual pivot axis for the cutting unit, wherein the virtual pivot axis is substantially parallel to a cutting edge of the cutting unit, wherein, in a first state of the swivel mechanism, the virtual pivot axis is located at a first position with respect to the cutting unit, wherein the cutting unit is adapted for shaving in the first state, and wherein, in a second state of the swivel mechanism, the virtual pivot axis is located at a second position with respect to the cutting unit that is different from the first position, wherein the cutting unit is adapted for styling in the second state.

This aspect is based on the insight that the cutting unit may assume distinct states that are adapted to certain cutting applications, and that it may profit from an adapted behavior of the mounting unit. Particularly the position of the (virtual) pivot axis may have a considerable impact on the swiveling behavior of the cutting unit that may be coupled to the mounting unit. Consequently, a mounting unit may be presented that may improve the capability of the cutting unit to cover an even wider range of application, particularly to enable shaving operations, styling operations and, even more preferably, also trimming operations.

It is worth mentioning in this regard that the swivel mechanism is preferably capable of setting the first state and the second state for a cutting unit coupled thereto. It is noted in this respect that the cutting unit as such may basically remain steady or unchanged when the swivel mechanism is transferred between the first state and the second state. However, since the cutting unit may be attached and/or coupled to the mounting unit that is fitted with the swivel mechanism, transferring of the swivel mechanism between the first state and the second state may actually trigger the shaving (also: shaving/trimming) mode and the styling mode of the cutting unit in which the cutting unit may be—application dependent—advantageously arranged and oriented with respect to the housing of the hair cutting appliance.

By way of example, the first state of the swivel mechanism, associated with the first position of the virtual pivot axis, may be referred to as a shaving state wherein the attached cutting unit is particularly adapted to shaving operations. In some embodiments, a (spacer) guard or comb may be attached to the cutting unit. Consequently, the cutting unit may be adapted to hair trimming applications in the first state as well. In the first state of the swivel mechanism, the respective blade set of the cutting unit, at least the cutting edge portion(s) thereof, is preferably orientated and guided basically parallel to the skin surface. Consequently, a shaving contact pressure or contact push force that is generally applied to the cutting unit by the user may be basically perpendicular to the blade set, particular to a top surface thereof.

By way of example, the second state of the swivel mechanism, associated with the second position of the virtual pivot axis, may be referred to as styling state wherein the attached cutting unit is particularly adapted to styling operations. Styling may involve precise cutting of edges of hair contours. For instance, styling operations may be envisaged wherein the user aims at precisely shaping an actual beard form, e.g. for shaping sideburns, a goatee, a mustache, etc. In the second state of the swivel mechanism, the respective blade set of the cutting unit, at least the cutting edge portion(s) thereof, is preferably orientated and guided basically perpendicular to the skin surface. Consequently, a styling contact pressure or contact push force, which may be applied to the cutting unit by the user, may be basically parallel to the blade set, particular to a top surface thereof.

It is worth mentioning in this regard, that, in some embodiments, at least one first state and at least one second state of the swivel mechanism may be enabled. For instance, the first state may basically correspond to a middle (or center) position of the swivel mechanism. Consequently, the swivel mechanism may be moved forth and back, starting from the middle position, thereby approaching a "first" second state and "second" second state, respectively. The "first" second state may be associated with a first end stop of the swivel mechanism. The "second" second state may be associated with a second end stop of the swivel mechanism. Particularly in cases where the blade set of the cutting unit comprises a first cutting edge and a second cutting edge that is arranged opposite the first cutting edge, two second states including two end positions may be present.

As used herein, the virtual pivot axis may be regarded as an actual (or instantaneous) rotation axis of the mounted cutting unit that is defined by the swivel mechanism of the mounting unit. During operation, the cutting unit may be, at least for some cutting applications, rotatable or, more precisely, pivotable with respect to the housing of the hair cutting appliance. Generally, the virtual pivot axis may be substantially parallel to at least one cutting edge of a blade set of the cutting unit. It is particularly preferred that the virtual pivot axis is moved along a defined path when the swivel mechanism is moved between the first state and the second state. It is further preferred that the virtual pivot axis is automatically moved along the defined path along with, and in response to, the motion of the swivel mechanism between the first state and the second state. In other words, it is even more preferred that the virtual pivot axis is capable of occupying the first position and the second position, respectively, without the need of operating an additional control element at the hair cutting appliance, such as a control knob or a control slider. It is therefore beneficial that the virtual pivot axis can be "operated" simply be moving the cutting unit itself. Consequently, handling and controlling the cutting appliance can be significantly simplified. Additional control elements can be avoided.

The above aspect is also based on the insight that shaving performance of the hair cutting appliance can be significantly improved by mounting the blade unit in a pivoting manner (or swiveling manner). The cutting unit may comprise a blade set having a skin side that faces the skin when shaving hair and that may comprise a basically planar or substantially flat extension. When the cutting unit is then pivoted at or pivotably connected to the housing of the hair cutting appliance, the contour following capability of the hair cutting appliance may be enhanced since the cutting unit may be somewhat self-aligning at the surface of the skin while performing, at the same time, a compensational relative (swiveling) motion with respect to the housing of the hair cutting appliance. Consequently, a user may grab and hold the hair cutting appliance at its housing in a tight or firm manner without the need to instantly adapt the orientation of the hair cutting appliance to an actual orientation of the skin surface. This may significantly improve the cutting performance while also mitigating the risk of skin irritation or even skin cuts.

It is particularly preferred that the swivel mechanism is arranged as a linkage mechanism. A linkage mechanism may be suitably designed so as to allow for a desired shift or motion of the virtual pivot axis. A linkage mechanism may be arranged, for instance, as a planar linkage mechanism, particularly as a four-bar linkage mechanism. However, also different forms of linkage mechanisms, and, more generally, different forms of swivel mechanisms can be utilized for achieving the desired functionality. Swivel mechanisms may comprise, for instance, knee joints, cam mechanisms, flexible structures, bi-stable spring joints, clicker mechanisms, etc.

Linkage mechanisms may comprise, for instance, four-bar linkage mechanisms, such as crankshaft mechanisms, crank rocker mechanisms, double rocker mechanisms, drag-link mechanisms, parallelogram linkage mechanisms, etc. Linkage mechanisms may further comprise five-bar linkage mechanisms, six-bar linkage mechanisms, etc. These "extended" linkage mechanisms may cooperate with additional drives and/or guide elements that may ensure a defined output motion. Consequently, the desired position(s) and arrangement of the (virtual) pivot can be achieved. Generally, a linkage mechanism may be regarded as a constrained system of coupling elements and respective pairing elements that is designed to convert motions of, and forces on, one or several coupling elements into motions of, and forces on, the remaining coupling elements in a desired manner.

In a preferred embodiment, the virtual pivot axis is substantially parallel to a cutting edge of the cutting unit, wherein the virtual pivot axis is preferably arranged in the vicinity of a top surface of the cutting unit facing away, when mounted, from the housing of the hair cutting appliance. The top surface of the cutting unit, particularly of the blade set thereof, may be regarded as the surface that is facing the skin when the cutting unit is used for shaving operations. For shaving operations, the top surface may be orientated basically parallel to the skin. For styling operations, the top surface may be orientated basically perpendicular to the skin.

As used herein, the terms perpendicular and parallel should not be construed in a limiting sense. It is recalled in this regard that the hair cutting appliance is typically manually guided by the user. Consequently, the orientation of the cutting appliance with respect to the skin may be somewhat unsteady. Therefore, the perpendicular and the parallel orientation are primarily provided for illustrative purposes. In general, when shaving, the orientation of the cutting unit with respect to the skin is clearly different from the orientation of the cutting unit with respect to the skin assumed when styling, preferably involving an angular offset by an offset angle that is about 90°±30°. As used herein, a basically parallel orientation may involve an angle between the involved elements that is about 0°±30°. As used herein, a basically perpendicular orientation may involve an angle between the involved elements that is about 90°±30°.

It is further preferred that the virtual pivot is offset from the skin-facing plane, also referred to as the top surface, defined by the cutting edges of the cutting unit, preferably towards the skin, when in use. Generally, the virtual pivot may be arranged above the blade set, i.e. "below" the skin surface, when shaving. Consequently, the pivoting responsivity of the cutting unit when being guided at the skin for shaving skin hairs can be adjusted accordingly. The contour following capability of the cutting unit may be further improved in this way. However, in some alternative embodiments, particularly for styling, the virtual pivot may be arranged above the skin level, i.e., rearwardly shifted from the skin-facing plane defined by the cutting edges of the cutting unit. The latter aspect may involve a beneficial self-locking tendency of the cutting unit in the second state.

In another preferred embodiment, the swivel mechanism is movable between a first swiveling position associated with the first state, particularly a neutral position, and at least one second swiveling position associated with the second state, particularly at least one end position, wherein the virtual pivot axis assumes, in the first swiveling position, a first height position $l_{o1}$ with respect to the top surface, particularly an elevated position, and wherein the virtual pivot axis assumes, in the second swiveling position, a second height position $l_{o2}$ with respect to the top surface, particularly a recessed position.

This arrangement may be particularly beneficial, since the virtual pivot axis may occupy a first (height) position with respect to the top surface that is particularly suited for shaving operations and a second (height) position that is particularly suited for styling operations. It is preferred that the virtual pivot axis is slightly elevated with respect to the top surface (i.e., towards the skin) in the first (height) position. Consequently, the virtual pivot axis may be shifted into the skin for shaving operations. This may be beneficial, since the contour following capability of the cutting unit can be further improved in this way. When moved over the skin, the cutting unit may be regarded as a lever that is associated with a respective fulcrum defined by the virtual pivot axis. This may be even further beneficial in cases when the virtual pivot is arranged in a center portion, or middle portion, of the blade set.

In other words, the blade set may be arranged and configured similar to a seesaw or beam balance mechanism. When contacting the skin, respective contact forces may pivot the blade set of the cutting unit about the virtual pivot axis. Consequently, a self-alignment functionality may be achieved, since a contact force applied to a first end of the lever may generate a swiveling motion about the fulcrum such that the first end is basically pushed away from the skin, whereas a second end of the lever that is opposite to the first end may be moved to the skin until a state of equilibrium is achieved. Consequently, the blade set can be guided substantially parallel to the skin. Self-alignment with respect to the skin may further improve the shaving capability.

It is, on the other hand, preferred that the virtual pivot axis is slightly recessed with respect to the top surface (i.e., towards the housing) in the second (height) position. This may be further beneficial since a basically self-locking functionality of the cutting unit may be achieved in this way, assuming that the swivel mechanism is slightly pushed into the second state. To this end, a press-on contact force may be generated by the user when using the hair cutting appliance for styling. Alternatively, or in addition, a biasing element may be utilized that slightly urges the swivel mechanism into to second state. The respective force may be generally parallel to the top surface of the blade set and may be generally perpendicular to a lateral extension of the actual cutting edge to be used to the styling operation. As discussed earlier, generally parallel may involve angles in the range of about 0°±30°. As discussed earlier, generally perpendicular may involve angles in the range of about 90°±30°. Preferably, the swivel mechanism is pushed against an end stop that that defines the respective position of the swivel mechanism and the virtual pivot axis in the second state.

In yet another preferred embodiment, the first height position of the virtual pivot axis and the second height position, with respect to the top surface, of the virtual pivot axis are offset by an overall pivot offset dimension $l_{op}$ in the range of about 0.5 mm to 12.0 mm, preferably in the range of about 1.0 mm to 6.0 mm, more preferably in the range of about 1.0 mm to 2.5 mm. Several swiveling mechanisms can be envisaged that may provide for a respective path, particularly a substantially vertically extending path, along which the virtual pivot axis is moved when the swivel mechanism is moved between the first state and the second state.

According to another embodiment, the first height position of the virtual pivot axis is offset from the top surface of the cutting unit by a first pivot offset dimension $l_{o1}$ in the range of about −2.0 mm to +5.0 mm, preferably in the range of about −1.0 mm to +2.0 mm, more preferably in the range of about +0.25 mm to +0.75 mm. As indicated above, it might be particularly beneficial that the virtual pivot axis is slightly elevated with respect to the top surface in the first position.

According to yet another embodiment, the second height position of the virtual pivot axis is offset from the top surface of the cutting unit by a second pivot offset dimension $l_{o2}$ in the range of about −6.0 mm to +1.0 mm, preferably in the range of about −4.0 mm to +0.0 mm, more preferably in the range of about −2.0 mm to −1.0 mm. As indicated above, it might be particularly beneficial that the virtual pivot axis is slightly recessed with respect to the top surface in the second position.

As used herein, + (plus) generally refers to an arrangement, wherein the pivot axis p is positioned above the level of the top surface, i.e. shifted "into" the skin. By contrast, − (minus) generally refers to an arrangement, wherein the pivot axis p is positioned below the level of the top surface, i.e. above the skin.

According to still another embodiment, a pivot angle $\alpha$ between the first swiveling position and the second swiveling position of the cutting unit is provided. In some embodiments, the pivot angle may be in the range of about 10° to about 50°. In some embodiments, the pivot angle may be in the range of about 15° to about 40°. In some embodiments, the pivot angle may be in the range of about 20° to about 25°. In some embodiments, the swiveling mechanism may be configured to swivel forth and back with respect to the first position in the first state. Consequently, the first state may be associated with a center or middle portion of the range of a total swivel angle composed of two ranges as indicated above. The total swivel angle may comprise a resulting range of about 20° to about 100° (e.g. ±10° to ±50°), 30° to 80°, or 40° to 50°, for instance. The indicated ranges are particularly beneficial since they represent an advantageous compromise that allows for an improved contour following capability in the shaving mode in the first state, and for a defined noticeable shift over to the styling mode in the second state, and vice versa. Furthermore, handling the hair cutting appliance may be improved since the housing thereof may be ergonomically designed and adapted to both the first state for shaving (and trimming, if required) and the second state for styling.

It is worth to be mentioned in this connection that both the first state and the second state may involve respective first and second positional ranges of the swivel mechanism. Consequently, also the virtual pivot may be positioned in respective first and second positional ranges with respect to the top surface of the blade set in the first state and in the second state.

As indicated above, it may be preferred, in some embodiments, that the swivel mechanism is arranged as a linkage mechanism. According to a further embodiment, the swivel mechanism is arranged as a four-bar linkage mechanism comprising a first arm and a second arm opposite to the first arm, the first arm comprising a first base pivot coupled to a base portion, the second arm comprising a second base pivot coupled to a base portion, the first base pivot and the second base pivot being arranged at the base portion at a defined distance, the first arm further comprising a first top pivot coupled to the top portion, particularly to a connecting bar, the second arm further comprising a second top pivot coupled to the top portion, particularly to the connecting bar, wherein the connecting bar is arranged to be coupled, at the top portion, to the cutting unit.

Since it is generally desired to reduce the size and the mass of the hair cutting appliance and particularly of the cutting unit thereof, there exist practical design limits for positioning a pivot for the cutting unit. Since the installation space for implementing a single-axis linkage unit, or a circular joint, a knee joint, etc., for the cutting unit might be limited, also a possible range of the area where the swiveling axis can be placed might be limited. Consequently, the mounting of such a conventional cutting unit may be regarded as adversely affecting the contour following capability of the cutting unit since a considerably poor swiveling behavior may occur.

It may be further preferred to implement a four-bar linkage mechanism for performing the mounting and supporting function. The four-bar linkage mechanism can be designed in a suitable manner, thereby defining a virtual pivot that may also be regarded as a moving (or floating) virtual pivot. By way of example, the four-bar linkage mechanism may be designed such that the virtual pivot is (virtually) arranged, at least in one of the first and the second state of the swivel mechanism, at a defined distance from the cutting unit that cannot be achieved with conventional single-pivot coupling mechanisms, given the installation available space. The resulting virtual pivot may be arranged at a portion of the hair cutting appliance that is basically obstructed by further components thereof.

The first state (or first position) may be regarded as the position of the linkage mechanism where the cutting unit is basically centered or in a basically neutral position. In other words, the cutting unit may be, in the first state (or first position), substantially parallel to the base or, more explicitly, substantially parallel to a plane defined by the first base pivot and the second base pivot.

In yet another embodiment of the mounting unit, at least one of the first base pivot, the second base pivot, the first top pivot and the second top pivot is arranged as a living hinge, wherein preferably all pivots of the four-bar linkage mechanism are arranged as living hinges, particularly as film hinges.

A living hinge may also be regarded as flexure bearing that is made from the same material as the parts that are connected in pivoting manner by the living hinge. It is further preferred in this regard that all pivots of the four-bar linkage mechanism are arranged as living hinges, particularly as film hinges. Film hinges or thin-film hinges may be manufactured, for instance, via an injection molding process. Consequently, at least one of the pivots and the respective neighboring parts connected by the pivot can be produced from basically the same material in an integral manner. This arrangement may further ensure that substantially no (mechanical) play is present in the pivots. Mechanical joints that are composed of separate components are typically designed in a clearance-fit manner including a defined play so as to allow a smooth pivoting motion. Moreover, film hinges may further have the advantage that any (internal) pollution of the joints can be prevented. According to another advantageous embodiment at least the first arm, the second arm and the connecting bar of the four-bar linkage mechanism and their respective base pivots and top pivots are integrally formed as a single piece.

This may be beneficial insofar as the four-bar linkage mechanism can be produced in basically a single production step. Particularly, time-consuming assembly steps can be avoided. It is further preferred in this regard that also the base of the four-bar linkage mechanism is at least partially integrated into the single piece shape.

Generally, it is desired that the linkage mechanism may be arranged to swivel about an axis that is parallel to the pivots defined by the film hinges. Film hinges are, on the one hand, basically designed for pivoting or swiveling about an axis that is defined by a thinned material section. However, since film hinges as such are typically made from considerably elastic material, the film hinges may also be moved, bent or deflected in other ways in response to respective external loads. Consequently, the cutting unit can be guided at the skin with far more flexibility, compared to conventional pivoting mechanisms for the cutting units of hair cutting appliances. In yet another embodiment, the four-bar linkage mechanism is an integrally formed injection molded plastic part. Preferably, plastic resins, such as polyethylene, polypropylene and similar materials having a sufficient fatigue resistance, may be used and processed for manufacturing the integrated four-bar linkage mechanism.

In still another embodiment of the mounting unit, the length of the base portion, defined by a distance between the first base pivot and the second base pivot, is greater than the length of the connecting bar, defined by a distance between the first top pivot and the second top pivot. The virtual pivot axis may be shifted upwards in this way in the first state, preferably above the level of the top surface or, in other words, into the skin. It goes without saying that the first arm and the second arm preferably may have substantially the same length, defined by a distance between their respective pivots.

It may be further preferred, in some embodiments, that the mounting unit further comprises at least one biasing element that urges the swivel mechanism into the second state. Additionally, or in the alternative, the mounting unit may comprise at least one end stop element for preventing undesired motion of the four-bar linkage mechanism. It is particularly preferred in this regard that the four-bar linkage mechanism is slightly urged into the second state (or second position) without play. The at least one biasing element may be defined and selected such that a defined restoring force is present that basically permanently urges the cutting unit into the second state. The restoring force is preferably small enough to be easily surmounted during operation of the hair cutting appliance, when the cutting unit is guided at the skin contour in the first state, for instance at a basically curved neck portion or chin portion thereof. Consequently, the mounting unit may be basically self-aligning with respect to the skin and, furthermore, self-restoring, just after an external load or force has been released.

The at least one end stop element may be arranged such that excessive motion at the living hinges may be prevented. Generally, the at least one end stop element may be shaped as a separate part or as a part integrated into the four-bar linkage mechanism. Particularly, the at least one end stop element may limit the swiveling angle of the cutting unit. It may be further preferred in this connection that the at least one end stop element cooperates with the at least one biasing element, wherein a resulting biasing force urges the four-bar linkage mechanism against at least one of the at least one end stop element. In this way, a defined second position for the cutting unit may be adopted. It may be further preferred in this regard, with the blade set slightly biased to the start position by the at least one biasing element, that the blade set may swivel between the defined "first" second position and a respective "second" second position that is defined by another one of the at least one end stop element when in operation.

In yet another embodiment of the mounting unit, the top portion, particularly the connecting bar, is coupled to the cutting unit, thereby defining a cutting head, the cutting unit comprising a blade set arranged to be moved through hair in an assumed moving direction to cut hair, said blade set comprising:

a stationary blade comprising at least one toothed cutting edge, wherein the stationary blade further comprises a top surface that is arranged, when in use for shaving purposes, as a skin-contacting surface, and a movable blade comprising at least one toothed cutting edge, wherein the stationary blade and the movable blade are arranged to be reciprocally moved with respect to each other in a cutting direction Y that is basically perpendicular to the assumed moving direction.

As used herein, the assumed moving direction may also be referred to as intended moving direction, particularly provided for illustrative purposes herein. It may be further assumed that the intended moving direction is typically substantially parallel to a longitudinal direction (also referred to as X direction for the purpose of this disclosure) of the blade set that is basically perpendicular to a lateral direction or a cutting direction.

It may be even further preferred in this regard that the stationary blade of the blade set at least partially encloses the movable blade, wherein the stationary blade comprises a first substantially flat wall portion that is arranged, when in use for shaving, as a skin-facing wall portion, and a second wall portion facing away from the skin, when in use for shaving, wherein the first wall portion and the second wall portion are connected at their at least one cutting edge, thereby defining a plurality of longitudinally extending stationary teeth alternating with respective tooth slots, and wherein the movable blade is guided in a guide slot between the first wall portion and the second wall portion, such that teeth of the movable blade, arranged at the at least one cutting edge thereof, cooperate with the stationary teeth to cut hairs caught in the tooth slots.

It may be further preferred that the stationary blade at least partially encloses the movable blade, wherein the stationary blade comprises a first substantially flat wall portion that is arranged, when in use, as a skin-facing wall portion, a second wall portion facing away from the skin, wherein the first wall portion and the second wall portion are connected at their at least one cutting edge, thereby defining a plurality of longitudinally extending stationary teeth alternating with respective tooth slots, wherein the movable blade is guided in a guide slot between a first wall portion and a second wall portion, such that teeth of the movable blade, arranged at the at least one cutting edge thereof, cooperate with the stationary teeth to cut hairs caught in the tooth slots.

In other words, more generally, the movable blade can be "sandwiched" between the first wall portion and the second wall portion of the stationary blade. This may provide the blade set, particularly the stationary blade thereof, with sufficient strength and thickness which may allow reducing the thickness of the first, skin-facing wall portion. Consequently, hairs can be cut even closer to the skin surface when shaving.

It is further preferred in this regard that the blade set comprises a first cutting edge and a second cutting edge longitudinally spaced from the first cutting edge, wherein the at least one lateral protecting element comprises a longitudinal extension that is adapted to an overall longitudinal extension of the stationary blade.

By way of example, a thickness of the first wall portion, at least at the at least one cutting edge, may be in the range of about 0.04 mm to about 0.25 mm, preferably in the range of about 0.04 mm to 0.18 mm, more preferably in the range of about 0.04 mm to 0.14 mm. The thickness of the second wall portion, at least at the at least one cutting edge, may be in the range of about 0.08 mm to 0.4 mm, preferably in the range of about 0.15 mm to 0.25 mm, more preferably in the range of about 0.18 mm to 0.22 mm. The thickness of the guide slot defined by the first wall portion and the second wall portion of the stationary blade, that is basically adapted to the thickness of the movable blade, at least at the at least one cutting edge, may be in the range of about 0.05 mm to about 0.5 mm, preferably in the range of about 0.05 mm to about 0.2 mm. An overall thickness or stack height, at least at the at least one cutting edge, may be in the range of about 0.3 mm to about 0.75 mm, preferably in the range of about 0.4 mm to about 0.5 mm.

Another aspect of the present disclosure is directed to a hair cutting appliance, particularly an electrically operated hair cutting appliance, comprising a housing accommodating a motor, a cutting unit, and a mounting unit in accordance with the principles of the present disclosure for coupling the cutting unit and the housing. Preferably, the mounting unit and the swivel mechanism thereof are formed in accordance with at least some of the aspects and embodiments discussed herein.

It is even further preferred that the hair cutting appliance is adapted for hair shaving operations when the swivel mechanism is in the first state, and that the hair cutting appliance is adapted for hair styling operations when the swivel mechanism is in the second state. It is worth noting in this connection that shaving operations and styling operations may be performed with the same blade set.

These and other features and advantages of the disclosure will be more fully understood from the following description of certain embodiments of the disclosure, taken together with the accompanying drawings, which are meant to illustrate and not to limit the disclosure.

BRIEF DESCRIPTION OF THE DRAWINGS

These and other aspects of the invention will be apparent from and elucidated with reference to the embodiments described hereinafter. In the following drawings

FIG. 3 is a perspective view of a first embodiment of a mounting unit arranged as a four-bar linkage mechanism for pivotably supporting a cutting unit, the mechanism being shown in a first state (or first position);

FIG. 4 is a simplified partial side view of a four-bar linkage mechanism similar to that one illustrated in FIG. 3 in an end position, e.g. a (first) second position;

FIG. 5 is a further partial side view corresponding to the view of FIG. 4, the four-bar linkage mechanism shown in another end position, e.g. a (second) second position;

DETAILED DESCRIPTION OF THE INVENTION

Figure 1:
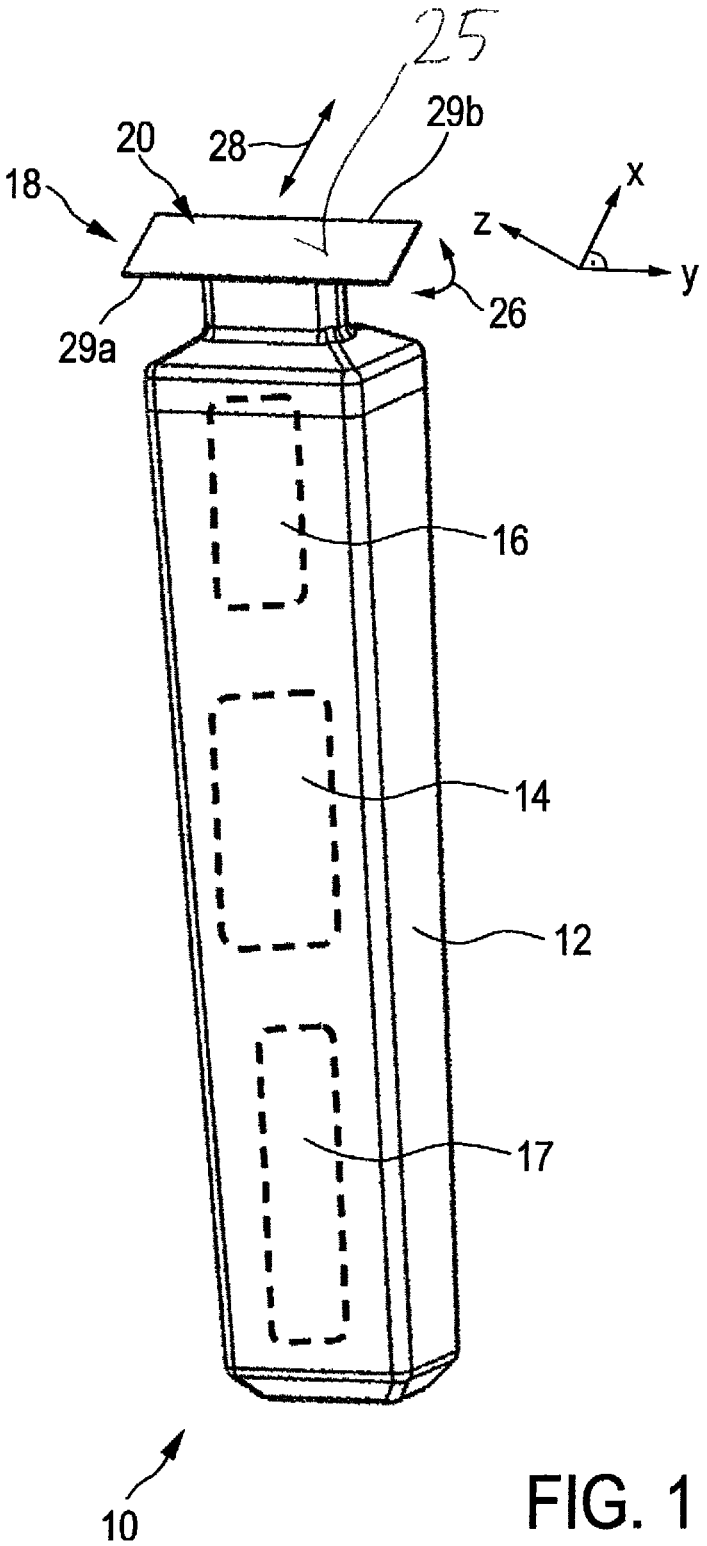
FIG. 1 shows a schematic perspective view of an exemplary electric hair cutting appliance fitted with an exemplary embodiment of a cutting unit that may be pivotably supported at the hair cutting appliance.

FIG. 1 schematically illustrates, in a simplified perspective view, an exemplary embodiment of a hair cutting appliance 10, particularly an electric hair cutting appliance 10. The cutting appliance 10 may include a housing 12, a motor indicated by a dashed block 14 in the housing 12, and a drive mechanism indicated by a dashed block 16 in the housing 12. For powering the motor 14, at least in some embodiments of the cutting appliance 10, an electrical battery, indicated by a dashed block 17 in the housing 12, may be provided, such as, for instance, a rechargeable battery, a replaceable battery, etc. However, in some embodiments, the cutting appliance 10 may be provided with a power cable for connecting a power supply. A power supply connector may be provided in addition or in the alternative to the (internal) electric battery 17.

The cutting appliance 10 may further comprise a cutting unit 18. At the cutting unit 18, a blade set 20 may be attached to the hair cutting appliance 10. The blade set 20 of the cutting unit 18 may be driven by the motor 14 via the drive mechanism 16 to enable a cutting motion.

Figure 2A:
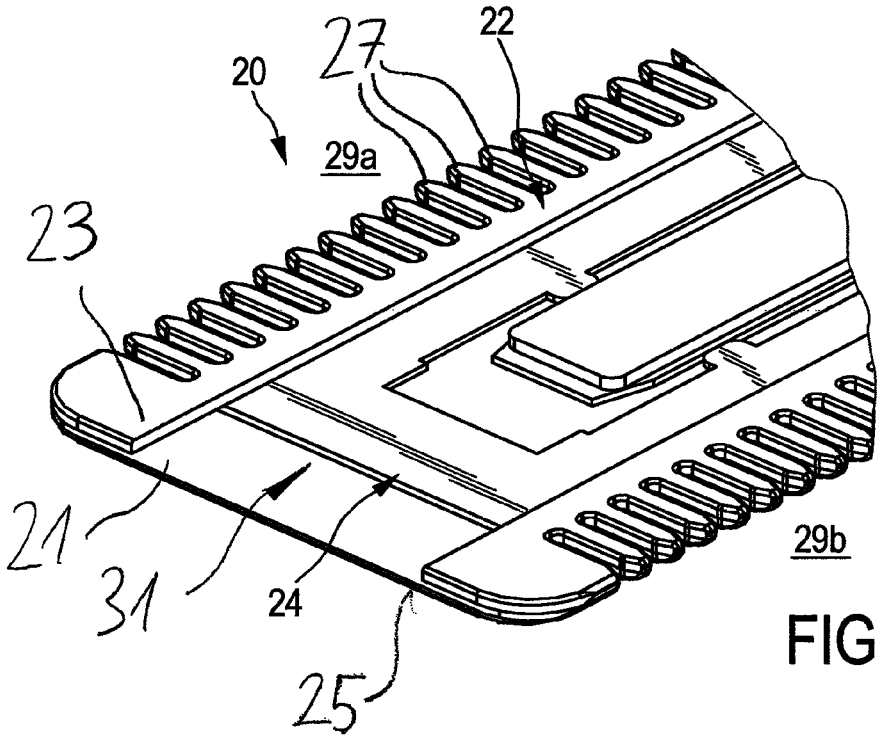
FIG. 2*a* is a partial perspective bottom view of a blade set of a cutting unit of a hair cutting appliance in accordance with FIG. 1.
Figure 2B:
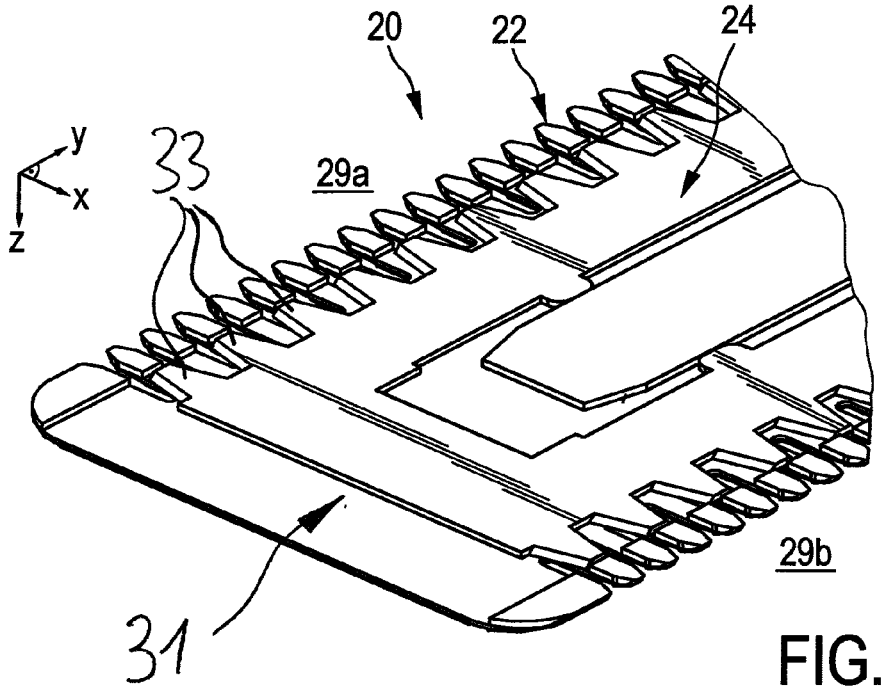
FIG. 2*b* is a further partial perspective bottom view corresponding to the view of FIG. 2*a*, a wall portion of the blade set being omitted primarily for illustrative purposes.

The cutting motion may be generally regarded as relative motion between a stationary blade 22 and a movable blade 24 of the blade set 20, see also FIGS. 2*a* and 2*b*. Generally, a user may grasp, hold and guide the cutting appliance 10 through hair in a moving direction 28 to cut hair. Furthermore, the blade set 20 can be arranged at the cutting unit 18 in a pivoting manner, refer to the curved double-arrow indicated by reference numeral 26. In some embodiments, the cutting appliance 10, or, more specifically, the cutting unit 18 including the blade set 20, can be passed along skin to cut hair growing at the skin. When cutting hair closely to the skin, basically a shaving operation can be performed aiming at cutting (or chopping) at the level of the skin. However, also clipping (or trimming) operations may be envisaged, wherein the cutting unit 18 comprising a blade set 20 is passed along a path at a desired distance relative to the skin. Furthermore, styling operations may be envisaged, as will be further discussed below.

When being guided or led through hair, the cutting appliance 10 including the blade set 20 is typically moved along a common moving direction which is indicated by the reference numeral 28 in FIG. 1. It is worth mentioning in this connection that, given that the hair cutting appliance 10 is typically manually guided and moved, the moving direction 28 thus not necessarily has to be construed as a precise geometric reference and having a fixed definition and relation with respect to the orientation of the cutting appliance 10 and its cutting unit 18 fitted with the blade set 20. That is, an overall orientation of the cutting appliance 10 with respect to the to-be-cut hair at the skin may be construed as somewhat unsteady. However, for illustrative purposes, it can be fairly assumed that the (imaginary) moving direction 28 is parallel (or generally parallel) to a main central plane of a coordinate system which may serve in the following as a means for describing structural features of the hair cutting appliance 10.

For ease of reference, coordinate systems are indicated in several of FIGS. 1 to 13. By way of example, a Cartesian coordinate system X-Y-Z is indicated in FIG. 1. An X axis of the respective coordinate system extends in a generally longitudinal direction that is generally associated with length, for the purpose of this disclosure. A Y axis of the coordinate system extends in a lateral (or transverse) direction associated with width, for the purpose of this disclosure. A Z axis of the coordinate system extends in a height (or vertical) direction which may be referred to for illustrative purposes, at least in some embodiments, as a generally vertical direction. It goes without saying that an association of the coordinate system to characteristic features and/or embodiments of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective Figs. and illustrations including different orientations.

FIGS. 2*a* and 2*b* illustrate a partial detailed view of the blade set 20 of the cutting unit 18 exemplarily shown in FIG. 1. The blade set 20 comprises a stationary blade 22 and a movable blade 24. The stationary blade 22 comprises a first wall portion 21 and a second wall portion 23. When in use for shaving, typically the first wall portion 21 faces the skin. A top surface of the stationary blade 22 is indicated by 25, see also FIGS. 1 and 3. The top surface 25 may be provided at the first wall portion 21 of the stationary blade 22. The top surface 25 basically faces the skin when the hair cutting appliance 10 is used for shaving operations. By way of example, the blade set 20 may comprise at least one basically laterally extending leading edge or cutting edge 29. It is preferred that the blade set 20 comprises two cutting edges 29*a*, 29*b* that are longitudinally spaced apart from each other. The cutting edges 29*a*, 29*b* may be spaced from each other in the moving direction 28 that is basically parallel to the direction X. The stationary blade 22 and the movable blade 24 may comprise a basically flat shape. It is particularly preferred that the stationary blade 22 is arranged to house and to guide the movable blade 24. In other words, the stationary blade 22 may be regarded as a shell or a cage for the movable blade 24. The stationary blade 22 may comprise a cross-section, viewed in the plane perpendicular to the lateral direction Y, that is basically U-shaped, particularly at the at least one cutting edge 29. The U shaped form may comprise a first leg and a second leg. Between the first leg and the second leg, a guide slot 31 for the movable blade 24 may be defined. The movable blade 24 can be housed and guided in the stationary blade 22 for lateral movement with respect to the stationary blade 22. The stationary blade 22 (refer to FIG. 2*a*) and the movable blade 24 (refer to FIG. 2*b*) may comprise respective teeth 27, 33 at their cutting edges 29 that allow cutting of hairs in a scissor-like action. The stationary blade 22 basically encloses the movable blade 24 at the side thereof facing the skin when cutting hair and, at least partially, at the side thereof facing away from the skin when cutting hair.

So as to suitably adapt the blade set 20 to shaving operations, it is preferred that a general height (or thickness) of the blade set 20, at least at the at least one cutting edge 29, is relatively small. Particularly, it is preferred that a skin-sided portion of the stationary blade 22 has a thickness that is relatively small. Even more preferably, the thickness of the stationary blade portion facing the skin is significantly smaller than the thickness of the stationary blade portion facing away from the skin, at least at the cutting edge 29. An exemplary blade set 20 for the hair cutting appliance 10 may comprise an overall height or thickness in the range of about 0.3 mm to about 0.75 mm. The height or thickness of the skin-facing portion of the stationary blade 22, at least at the at least one cutting edge, may be in the range of about 0.04 mm to about 0.25 mm. The height or thickness of the stationary blade portion facing away from the skin may be in the range of about 0.08 mm to about 0.4 mm. The height thickness of the movable blade 24, at least at the least one cutting edge, may be in the range of about 0.05 mm to about 0.5 mm. The height of the movable blade 24 may basically correspond to a height of the guide slot 31 defined by the stationary blade 22 for the movable blade 24.

It is particularly preferred that the cutting unit 18 including the blade set 20 is pivoted or pivotably supported at the housing 12 of the hair cutting appliance 10. To this end, a mounting unit 30 in accordance with the principles of the present disclosure may be utilized. Reference is made in this regard to FIGS. 3, 4 and 5. FIG. 3 illustrates a perspective view of a first embodiment of the mounting unit 30 that is configured to support the cutting unit 18. The mounting unit 30 and the cutting unit 18 may define a cutting head of the hair cutting appliance 10. The mounting unit 30 may comprise a swiveling mechanism 32, particularly a linkage mechanism, more particularly a four-bar linkage mechanism that is arranged between the blade set 20 and the housing 12 of the cutting appliance 10, refer to FIG. 1. Different types of swiveling mechanisms 32 may be envisaged. The present disclosure is not limited to linkage mechanisms like four-bar linkage mechanisms.

With further reference to FIG. 3, the mounting unit 30 and the swiveling mechanism 32 are further detailed and exemplarily shown as comprising a first linkage section 34 and a second linkage section 36. The first linkage section 34 and the second linkage section 36 may be spaced from each other in the X-direction. However, it may be envisaged that in some embodiments the four-bar linkage mechanism 32 basically comprises a single linkage section. The four-bar linkage mechanism 32 may be configured so as to permit a swiveling or pivoting motion of the cutting unit 18 about a (virtual) pivot axis p that is a basically parallel to the Y-axis and, consequently, basically parallel to the at least one cutting edge 29*a*, 29*b*, refer also to FIGS. 8 and 9 in this connection. A resulting swiveling motion during operation, e.g., when following an actual skin contour, is indicated in FIGS. 4 and 5 by respective double-arrows 26. FIG. 3 may indicate a middle position, particularly a first position of the swiveling mechanism 32, when the swiveling mechanism 32 is in a first state. FIG. 4 may indicate a (first) end position, particularly a (first) second position, when the swiveling mechanism 32 is in a (first) second state. FIG. 5 may indicate a (second) end position, particularly a (second) second position, when the swiveling mechanism 32 is in a (second) second state. In the first state, the cutting unit 18 and the hair cutting appliance fitted therewith is particularly suited for shaving operations, as will be discussed further below. In the second state(s), the cutting unit 18 and the hair cutting appliance fitted therewith is particularly suited for styling operations, as will be discussed further below.

The four-bar linkage mechanism 32 or, in some embodiments, each linkage section 34, 36 thereof, may comprise a base portion 38. In accordance with the exemplary embodiment shown in FIGS. 3, 4 and 5, the base portion 38 may comprise a first base element 40*a* and a second base element 40*b*. The base elements 40*a* and 40*b* may be spaced from each other in the longitudinal direction X. Generally, the base portion 38 may be coupled or connected to the housing 12 of the hair cutting appliance 10 without considerable play during operation, such that basically no relative motion between the base portion 38 and the housing 12 is permitted. The swiveling mechanism 32, or each respective section 34, 36 thereof, may further comprise a first arm 42 and a respective second arm 44. The first arm 42 and the second arm 44 may be spaced from each other in the longitudinal direction X. Furthermore, a top portion or connecting bar 46 may be provided to which the blade set 20 of the cutting unit 18 may be connected or coupled. The respective members of the swiveling mechanism 32 may be movably or pivotably connected by respective pivots 48, 50, 52, 54. A first base pivot 48 may be arranged to connect the first arm 42 and the base portion 38 for a respective base element 40*a* thereof. The second base pivot 50 may be arranged to connect the second arm 44 and the base portion 38 or a respective base element 40*b* thereof. The first top pivot 52 may be configured to connect the first arm 42 and the top portion or connecting bar 46. Similarly, the second top pivot 54 may be configured to connect the second arm 44 and the connecting bar 46. Consequently, the top pivots 52, 54 may be spaced from the base pivots 50, 52 in the vertical direction Z.

At least one or, more preferably, each of the pivots 48, 50, 52, 54 may be arranged as a living hinge. Particularly, the pivots 48, 50, 52, 54 may be arranged as film hinges. In other words, the base portion 38 including the base elements 40*a*, 40*b*, the first arm 42, the second arm 44 and the connecting bar 46 including their interposed pivots 48,50, 52, 54 may be integrally manufactured as a single piece, refer also to FIGS. 4 and 5. For instance, the four-bar linkage mechanism 32 may be formed as a single injection-molded part. As can be best seen in FIG. 3, the first linkage section 34 and the second linkage section 36 may be integrally formed as well. However, in the alternative, each of the first linkage section 34 and the second linkage section 36 may be formed as separate integrally-shaped part.

As can be further seen from FIG. 3, the connecting bar 46 may further comprise at least one side arm 56, particularly a first side arm 56*a* and a second side arm 56*b* that may be coupled to the blade set 20. Each of the side arms 56*a*, 56*b* may extend outwardly from the connecting bar 46. The at least one side arm 56*a*, 56*b* may be inclined with respect to the connecting bar 46, and to the blade set 20. It is worth noting in this connection that, as discussed and described herein, structural features and relationships may typically refer to the first state (associated with a first position or middle position) of the mounting unit 30 as shown, for instance, in FIGS. 3, 6, 8, 10 and 12, unless otherwise indicated.

Figure 6:
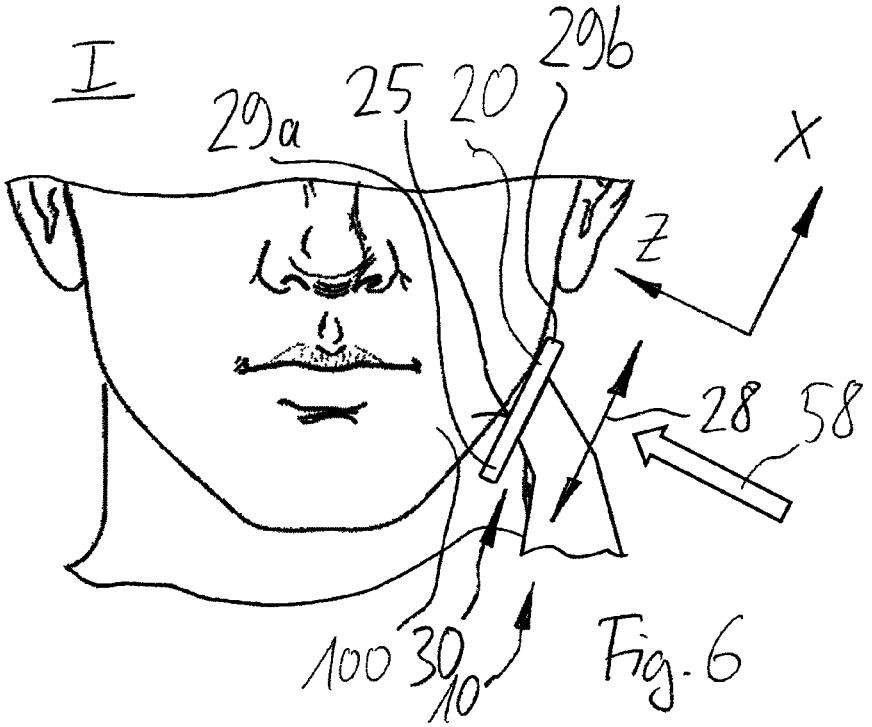
FIG. 6 is a simplified partial side view of a hair cutting appliance in a first state, when in use for shaving.
Figure 7:
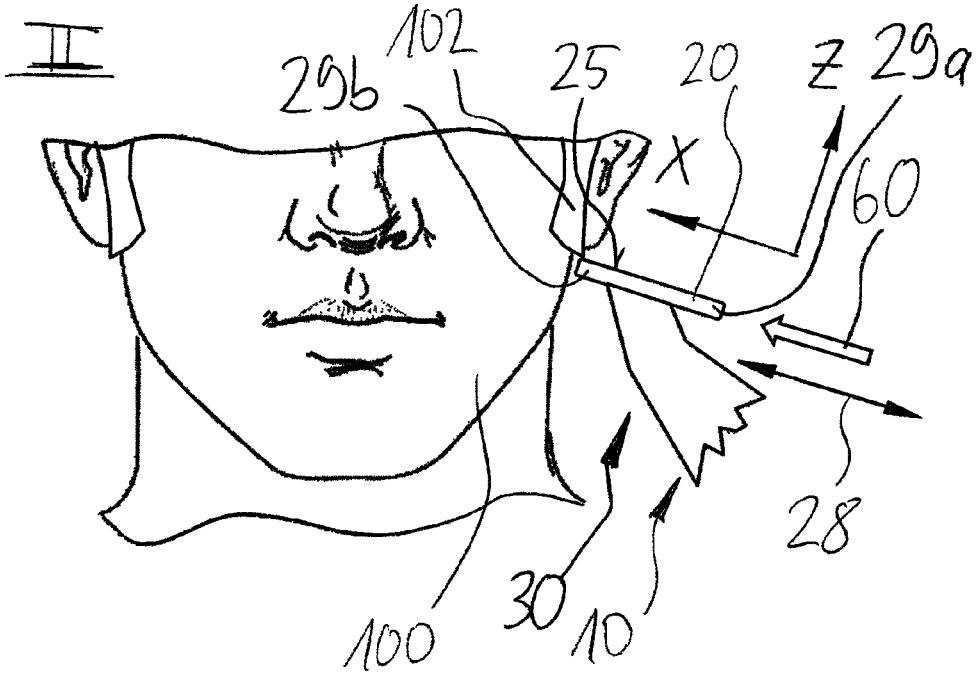
FIG. 7 is a simplified partial side view of a hair cutting appliance in a second state, when in use for styling.

With particular reference to FIGS. 6 and 7, exemplary orientations and moving directions for a hair cutting appliance 10 (only partially shown in FIGS. 6 to 9) including a mounting unit 30 in accordance with the principles of the present disclosure are illustrated. A first state I of the mounting unit 30 is illustrated in FIG. 6. A second state II of the mounting unit 30 is illustrated in FIG. 7. The first state I may also be referred to as shaving state, while basically also trimming operations may be performed in the first state I. The second state may also be referred to as styling state. In the first state I, the blade set 20 of the hair cutting appliance 10 is orientated basically parallel to a to-be-shaved skin portion 100 of a user. The top surface 25 of the blade set faces the skin portion 100. Also the moving direction 28 is orientated basically parallel to the skin portion 100. Facial hair can be trapped and cut at the cutting edges 29*a*, 29*b* of the blade set 20. A push force or contact force 58 may be applied to the blade set 20 that is basically perpendicular to the top surface 25 or, more generally, basically perpendicular to the longitudinal extension (X-direction) and the lateral extension (Y-direction) of the blade set 20. The contact force 58 may be also basically perpendicular to the moving direction 28.

FIG. 7 illustrates the second state II of the mounting unit 30, when in use for styling purposes. For instance, a need to style the precise shape of sideburns 102 in the skin portion 100 of the user may exist. To this end, the user may basically rotate the hair cutting appliance 10 such that the blade set 20, and particularly the top surface 25 thereof is orientated basically perpendicular to the to-be-processed skin portion 100. As can be further seen from FIG. 7, the moving direction 28 may be basically perpendicular to the skin portion 100 as well. In contrast to the first state I, a push force, or contact force 60 may be applied to the blade set 20 in the second state II that is basically parallel to the top surface 25 or, more generally, basically parallel to the longitudinal extension (X-direction) and the lateral extension (Y-direction) of the blade set 20. The contact force 60 may be also basically parallel to the moving direction 28. Once the movement towards the skin has been completed, a movement along the skin portion 100 may follow so as to complete an actual styling stroke before starting the next styling stroke.

While it is desired in the first state I that the blade set 20 is mounted at the hair cutting appliance 10 with the ability to freely swivel so as to smoothly follow the contour of the sin portion 100 when being moved over the skin portion 100 in the moving direction 28, such behavior of the blade set 20 might be cumbersome in the second state II. In the second state it would be rather desirable to "lock" the blade set 20 so as to enable precise styling cuts. However, manually locking the blade set 20 so as to switch it into the second state II is considered as adversely affecting the user comfort and the ease of use capability of the hair cutting appliance 10. The present disclosure therefore provides for a mounting unit 30 that may improve the operational performance and the ease of use capability of the hair cutting appliance 10 in both the first state I and the second state II.

Figure 8:
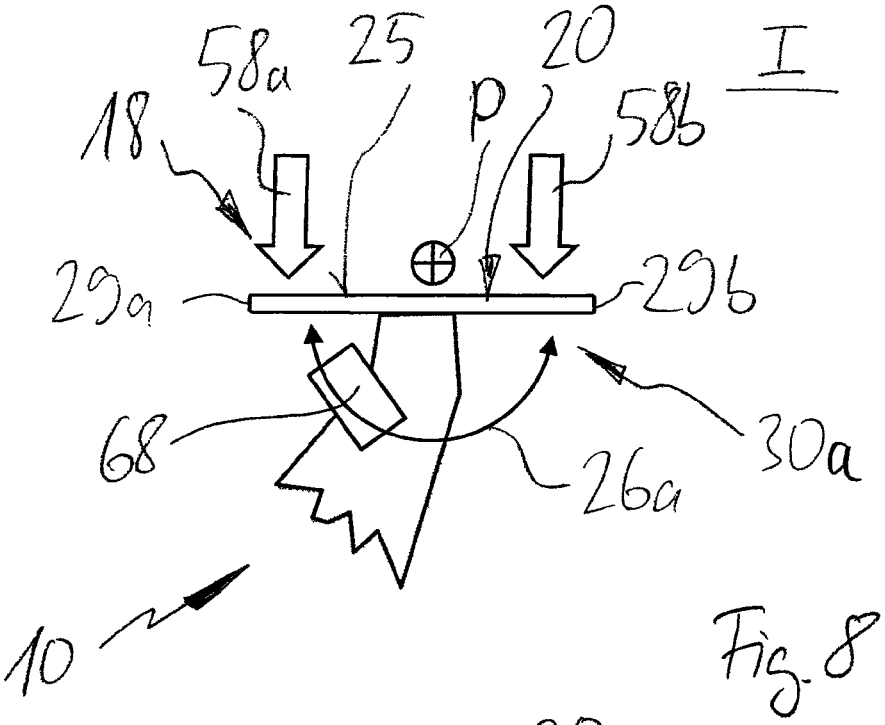
FIG. 8 is a simplified partial side view of a hair cutting appliance similar to that one illustrated in FIG. 6 in a first state.
Figure 9:
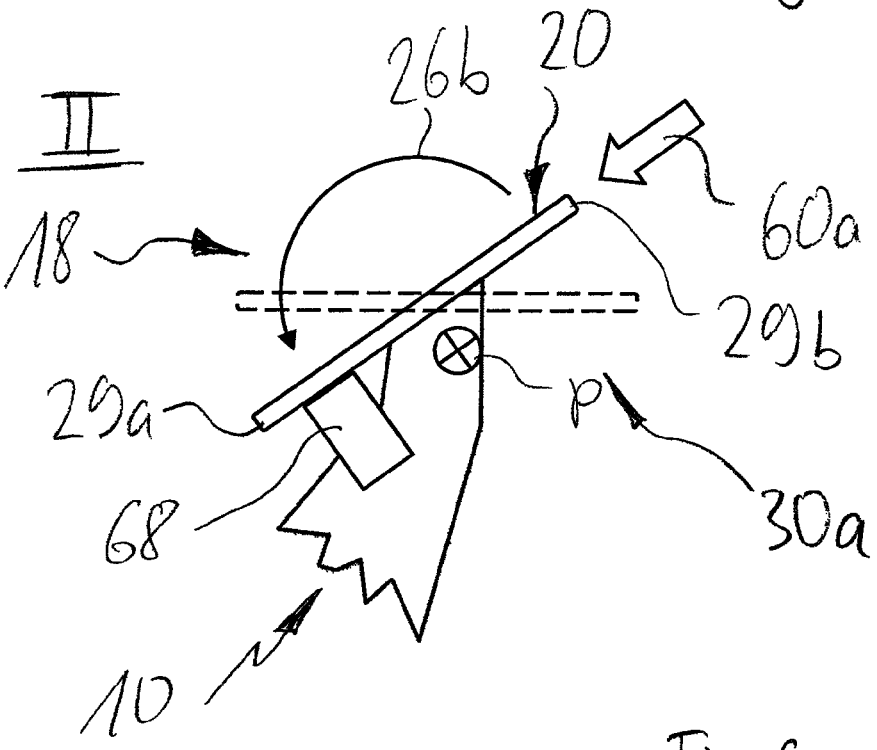
FIG. 9 is a simplified partial side view of a hair cutting appliance similar to that one illustrated in FIG. 7 in a second state.

With particular reference to FIGS. 8 and 9, an exemplary embodiment of a mounting unit 30*a* in accordance with at least some of the principles of the present disclosure is presented and further detailed. The mounting unit 30*a* is shown in FIG. 8 in the first state I and in FIG. 9 in the second state II. The mounting unit 30*a* may be capable of pivotably supporting a cutting unit 18 that is fitted with the blade set 20, refer to the arrows 26*a*, 26*b* in FIGS. 8 and 9 indicating the swiveling motion of the blade set 20. As shown in FIG. 8, the cutting unit 18 including the blade set 20 may rotate or swivel freely about a pivot axis p in the first state I. The pivot axis p may be regarded as a virtual pivot axis p defined by a respective coupler mechanism, refer particularly to FIGS. 10 to 13 in this regard. In the first state I, the virtual pivot axis p may be offset from the blade set 20, particularly from a top surface 25 thereof (refer also to FIG. 1) towards the side of the blade set 20 that faces the skin when shaving or trimming hair. As can be further seen from FIG. 9, in the second state II, the virtual pivot axis p may be offset from the top surface 25 of the blade set 20 in the opposite direction towards the housing 12 of the hair cutting appliance 10 (refer also to FIG. 1). In other words, the virtual pivot p can be moved or shifted between a first position associated with the first state I and a second position associated with the second state II.

It is particularly preferred that the shift of the virtual pivot p may be achieved by simply shifting the mounting unit 30*a* from the first state I to the second state II. As can be seen from FIGS. 8 and 9, in some embodiments, the cutting unit 18 comprising the blade set 20 may be pivoted from a first swiveling position associated with the first state I to a second swiveling position associated with the second state II so as to cause the motion of the virtual pivot p.

Locating the virtual pivot p above the level of the top surface 25 in the first state I may be beneficial since the contour following capability may be even further improved in this way. The blade set 20 may basically swivel freely about the virtual pivot axis p such that contact forces 58*a*, 58*b* that are applied basically perpendicular to the top surface 25 may cause a reaction that aligns the blade set 20 with the skin when shaving. Locating the virtual pivot p below the level of the top surface 25 in the second state II may be beneficial since the blade set 20 may be "locked" with little effort in this way by applying a small contact force 60*a* thereon.

It may be preferred in some embodiments to provide for an end stop element 68 at the hair cutting appliance 10 that limits the swiveling motion of the mounting unit 30*a* and, consequently, defines a second position of the virtual pivot axis p in the second state II of the mounting unit 30*a*.

Figure 10:
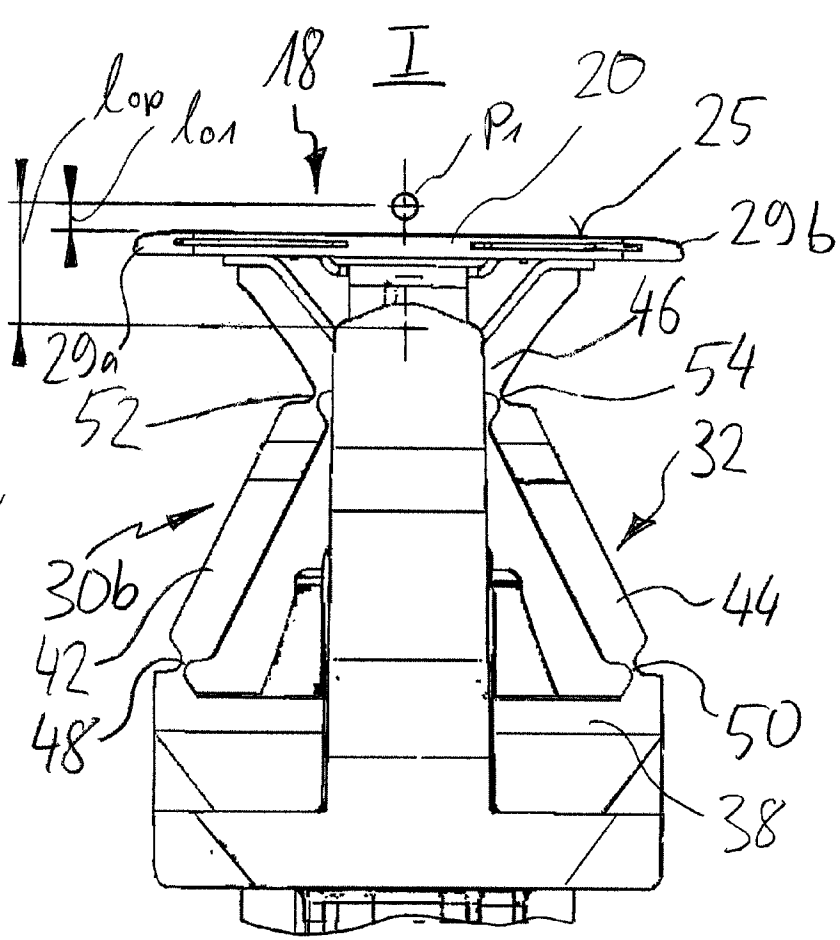
FIG. 10 is a simplified side view of another embodiment of a mounting unit arranged a four-bar linkage mechanism similar to that one illustrated in FIG. 3 in a first state.
Figure 11:
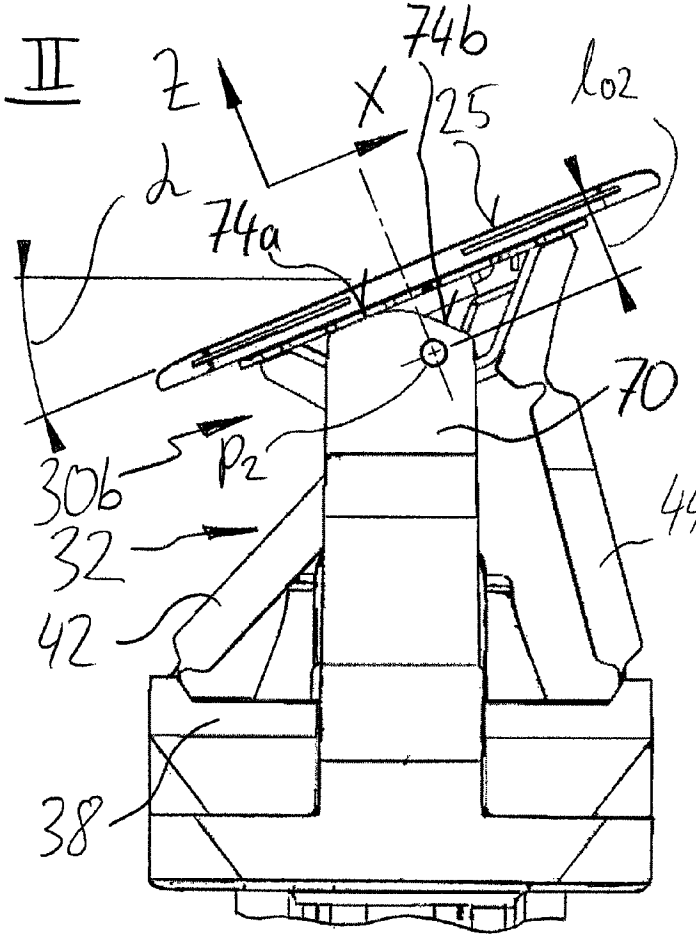
FIG. 11 is a further side view corresponding to the view of FIG. 10, the mounting unit shown in a second state.

With particular reference to FIGS. 10 and 11, another alternative embodiment of a mounting unit 30*b* for pivotably connecting a cutting unit 18 and a housing 12 of a hair cutting appliance 10 (refer also to FIG. 1) is illustrated and further detailed. As already discussed in connection with FIGS. 3 to 5, the mounting unit 30*b* may comprise a swiveling mechanism 32, for instance a four-bar linkage mechanism. The swiveling mechanism 32 may be configured such that a virtual pivot axis p for the cutting unit 18 is defined that occupies a first position $p_1$ in the first state I illustrated in FIG. 10 and a second position $p_2$ in the second state II illustrated in FIG. 11. In the first state I, the virtual pivot axis p may be offset from the top surface 25 of the blade set 20 by a first (vertical) pivot offset dimension $l_{o1}$. Preferred ranges for the first pivot offset dimension $l_{o1}$ are indicated above. In the second state II, the virtual pivot axis p may be offset from the top surface 25 of the blade set 20 by a second (vertical) pivot offset dimension $l_{o2}$. Preferred ranges for the second pivot offset dimension $l_{o2}$ are indicated above. An overall offset between the first position $p_1$ and the second position $p_2$ of the virtual pivot axis p may be indicated by an overall pivot offset dimension $l_{op}$. Preferred ranges for overall pivot offset dimension $l_{op}$ are indicated above.

When being moved between the first state I and the second state II, the cutting unit 18 comprising the blade set 20 may be pivoted by an angular offset dimension $\alpha$ (alpha). It is worth to be mentioned in this connection that, in some embodiments, the mounting unit 30*b* may be arranged to provide a first position associated with the first state I and a "first" and a "second" second position associated with the second state II. In other words, depending on the direction of rotation of the mounting unit 30*b*, the "first" or the "second" second position may be achieved. In some embodiments, the mounting unit 30*b* may be arranged basically symmetric with respect to a plane define by the vertical direction or height direction Z and the lateral direction Y.

The angular offset dimension α (alpha) of the blade set 20 may be defined by an end stop element or an end stop beam 70. The end stop beam 70 may be coupled to the base portion 38 of the mounting unit 30*b*. The end stop beam 70 may be provided with a first end face 74*a* that defines a first end position of the mounting unit 30*b* in the second state II which is associated with the "first" second position. The end stop beam 70 may be further provided with a second end face 74*b* that defines a second end position of the mounting unit 30*b* in the second state II which is associated with the "second" second position.

Figure 12:
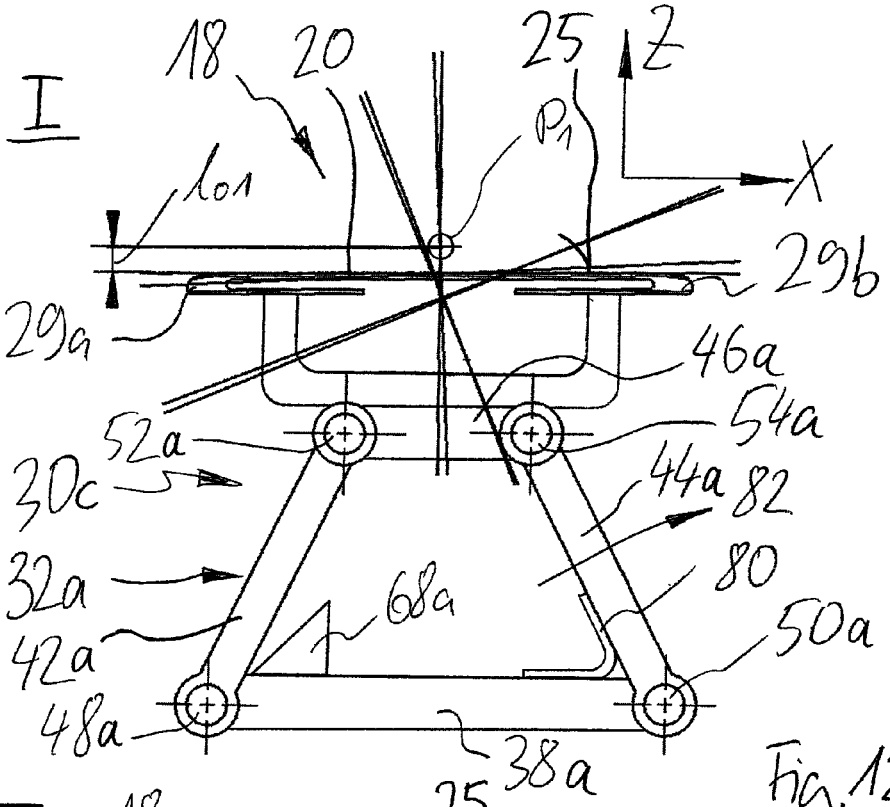
FIG. 12 is a simplified side view of yet another embodiment of a mounting unit in a first state.
Figure 13:
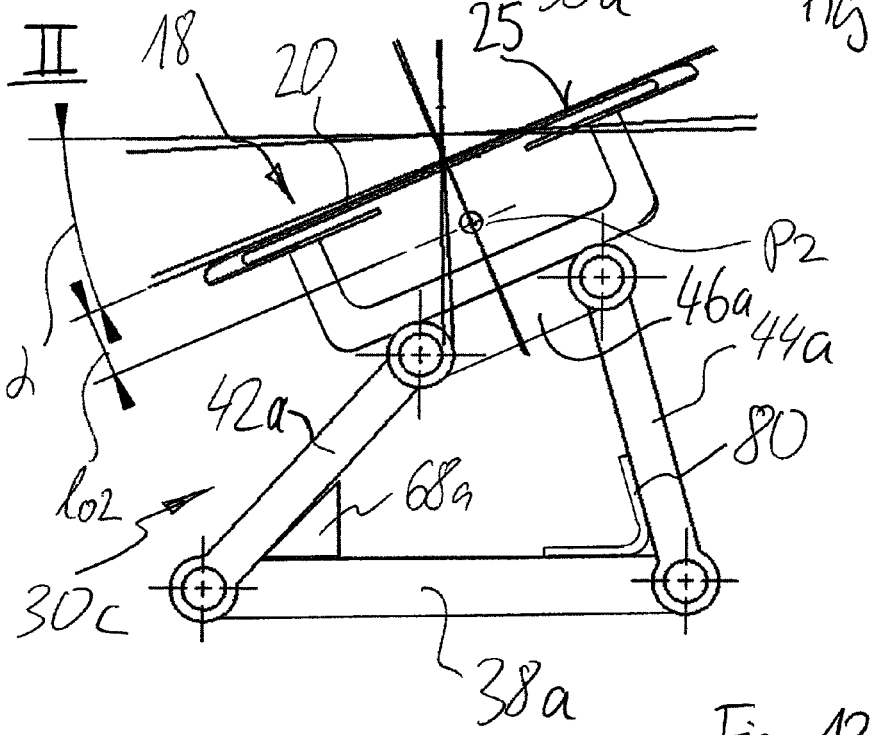
FIG. 13 is a further side view corresponding to the view of FIG. 12, the mounting unit shown in a second state.

With particular reference to FIGS. 12 and 13, yet another alternative embodiment of a mounting unit 30*c* for pivotably connecting a cutting unit 18 and a housing 12 of a hair cutting appliance 10 (refer also to FIG. 1) is illustrated and further detailed. The mounting unit 30*c* comprises a swiveling mechanism 32*a* arranged as a four-bar-linkage mechanism that is provided with at least one pivot joint that may comprise a pivot pin that cooperates with two to-be-coupled elements, e.g. via at least one respective distinct pivot seat. The pivot pin can be received at the at least one pivot seat. The pivot pin and the pivot seat may cooperate so as to define a pivot bearing.

The four-bar-linkage mechanism 32*a* may comprise a base portion 38*a*, a first arm 42*a*, a second arm 44*a*, and a connecting bar 46*a*. The base portion 38*a* is interposed between the first arm 42*a* and the second arm 44*a* at a base end thereof. The connecting bar 46*a* is interposed between the first arm 42*a* and the second arm 44*a* at a top end thereof. Between the base portion 38*a* and the first arm 42*a*, a first base pivot or base pivot joint 48*a* may be provided. Between the base portion 38*a* and the second arm 44*a*, a second base pivot or base pivot joint 50*a* may be provided. Between the connecting bar 46*a* and the first arm 42*a*, a first top pivot or top pivot joint 52*a* may be provided. Between the connecting bar 46*a* and the second arm 44*a*, a second top pivot or top pivot joint 54*a* may be provided. It goes without saying that at least one of the pivots 48*a*, 50*a*, 52*a*, 54*a* may be provided as a living hinge. However, it may be preferred in connection with the embodiment shown in FIGS. 12 and 13 that each of the pivots 48*a*, 50*a*, 52*a*, 54*a* is an assembled pivot joint comprising at least one distinct part that is not integrally formed with both respective the to-be-coupled elements.

Also the four-bar-linkage mechanism 32*a* of FIGS. 12 and 13 may define a virtual pivot axis $p_1$ that may be, in the first state I (or first position) illustrated in FIG. 12, offset from the top surface 25 of the blade set 20 in the vertical direction Z towards the skin by a pivot offset dimension $l_{o1}$, as discussed above. In the second state II (or second position) illustrated in FIG. 13, the virtual pivot axis $p_2$ may be offset from the top surface 25 of the blade set 20 in the vertical direction Z towards the housing 12 of the hair cutting 10 appliance by a pivot offset dimension $l_{o2}$, as discussed above. In the second state II, the mounting unit 30*c* may be adapted to styling operations, refer to FIG. 7. In the first state I, the mounting unit 30*c* may be adapted to shaving operations, refer to FIG. 6.

As can be further seen from FIGS. 12 and 13, the mounting unit 30*c* may further comprise at least biasing element 80 that is configured to urge or push the swiveling mechanism 30*c* into the second state II. Furthermore, at least one end stop element 68*a* may be provided that defines an end position (second position) of the swiveling mechanism 30*c* in the second state II. The end stop element 68*a* may be configured to limit the swiveling angle α (alpha) of the cutting unit 18 pivotably supported by the swiveling mechanism 30*c*.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims. Reference throughout this specification to "one embodiment" or "an embodiment" means that a particular feature, structure or characteristic described in connection with the embodiment is included in at least one embodiment of the stationary blade, the blade set, etc. according to the present disclosure. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A mounting unit being configured to be coupled to a cutting unit and a housing of a hair cutting appliance, said mounting unit comprising:

a swivel mechanism including:

a base portion arranged to be coupled to the housing, and a top portion arranged to be fixedly coupled to the cutting unit, wherein the base portion and the top portion are movable with respect to each other, such that, during operation, the cutting unit is pivotably supported by the swivel mechanism, wherein the swivel mechanism defines a virtual pivot axis for the cutting unit, wherein the virtual pivot axis is substantially parallel to a cutting edge of the cutting unit, wherein, in a first state of the swivel mechanism, the virtual pivot axis is located at a first position with respect to the cutting unit, wherein the cutting unit is adapted for shaving in the first state, wherein, in a second state of the swivel mechanism, the virtual pivot axis is located at a second position with respect to the cutting unit that is different from the first position, wherein the cutting unit is adapted for styling in the second state, wherein the swivel mechanism is movable between a first swiveling position associated with the first state, and at least one second swiveling position associated with the second state, wherein, in the first swiveling position, the swivel mechanism is configured to move the virtual pivot axis to a first height position which is elevated with respect to a top surface of the cutting unit in response to a first force, and in the second swiveling position, the swivel mechanism is configured to move the virtual pivot axis to a second height position which is recessed with respect to the top surface in response to a second force different from the first force, and wherein a connecting bar of the top portion is coupled to the cutting unit, thereby defining a cutting head, the cutting unit comprising a blade set arranged to be moved through hair in an assumed moving direction to cut hair, said blade set comprising:

a stationary blade comprising at least one toothed cutting edge, wherein the stationary blade further comprises a top surface that is arranged, when in use for shaving purposes, as a skin-contacting surface, and a movable blade comprising at least one toothed cutting edge, wherein the stationary blade and the movable blade are arranged to be reciprocally moved with respect to each other in a cutting direction that is perpendicular to the assumed moving direction.

2. The mounting unit as claimed in claim 1, wherein the stationary blade of the blade set at least partially encloses the movable blade, wherein the stationary blade comprises a first wall portion that is arranged, when in use for shaving, as a skin-facing wall portion, and a second wall portion facing away from the skin, when in use for shaving, wherein the first wall portion and the second wall portion are connected at the at least one toothed cutting edge of the stationary blade, thereby defining a plurality of longitudinally extending stationary teeth alternating with respective tooth slots, and wherein the movable blade is guided in a guide slot between the first wall portion and the second wall portion of the stationary blade, such that teeth of the movable blade, arranged at the at least one toothed cutting edge of the movable blade, cooperate with the stationary teeth to cut hairs caught in the tooth slots.

3. A mounting unit for coupling a cutting unit and a housing of a hair cutting appliance, said mounting unit comprising:

a swivel mechanism arranged as a four-bar linkage mechanism and including:

a base portion arranged to be coupled to the housing, and a top portion arranged to be coupled to the cutting unit; and at least one biasing element that urges the swivel mechanism into a second state, and wherein the mounting unit comprises at least one end stop element for preventing undesired motion of the four-bar linkage mechanism, wherein the base portion and the top portion are movable with respect to each other, such that, during operation, the cutting unit is pivotably supported by the swivel mechanism, wherein the swivel mechanism defines a virtual pivot axis for the cutting unit, wherein the virtual pivot axis is substantially parallel to a cutting edge of the cutting unit, wherein, in a first state of the swivel mechanism, the virtual pivot axis is located at a first position with respect to the cutting unit, wherein the cutting unit is adapted for shaving in the first state, wherein, in the second state of the swivel mechanism, the virtual pivot axis is located at a second position with respect to the cutting unit that is different from the first position, wherein the cutting unit is adapted for styling in the second state, wherein the swivel mechanism is movable between a first swiveling position associated with the first state, and at least one second swiveling position associated with the second state, and wherein the virtual pivot axis assumes, in the first swiveling position, an elevated, first height position with respect to a top surface of the cutting unit facing away, when mounted, from the housing of the hair cutting appliance, and wherein the virtual pivot axis assumes, in the second swiveling position, a recessed, second height position with respect to the top surface.

4. The mounting unit as claimed in claim 3, wherein the four-bar linkage mechanism comprises a first arm and a second arm opposite to the first arm, the first arm comprising a first base pivot coupled to the base portion, the second arm comprising a second base pivot coupled to the base portion, the first base pivot and the second base pivot being arranged at the base portion at a defined distance, the first arm further comprising a first top pivot coupled to a connecting bar, the second arm further comprising a second top pivot coupled to the connecting bar, wherein the connecting bar is arranged to be coupled, at the top portion, to the cutting unit.

5. The mounting unit as claimed in claim 4, wherein at least one of the first base pivot, the second base pivot, the first top pivot and the second top pivot is arranged as a living hinge.

6. The mounting unit as claimed in claim 4, wherein a length of the base portion, defined by a distance between the first base pivot and the second base pivot, is greater than the length of the connecting bar, defined by a distance between the first top pivot and the second top pivot.

7. A mounting unit for coupling a cutting unit and a housing of a hair cutting appliance, said mounting unit comprising:

a swivel mechanism including:

a base portion arranged to be coupled to the housing, and a top portion arranged to be fixedly coupled to the cutting unit, wherein the base portion and the top portion are movable with respect to each other, such that, during operation, the cutting unit is pivotably supported by the swivel mechanism, wherein the swivel mechanism defines a virtual pivot axis for the cutting unit, wherein the virtual pivot axis is substantially parallel to a cutting edge of the cutting unit, wherein, in a first state of the swivel mechanism, the virtual pivot axis is located at a first position with respect to the cutting unit, wherein the cutting unit is adapted for shaving in the first state, wherein, in a second state of the swivel mechanism, the virtual pivot axis is located at a second position with respect to the cutting unit that is different from the first position, wherein the cutting unit is adapted for styling in the second state, wherein the swivel mechanism is movable between a first swiveling position associated with the first state, and at least one second swiveling position associated with the second state, and wherein, in response to a first force that moves the swivel mechanism to the first swiveling position, the virtual pivot axis moves to a first height position which is elevated with respect to a top surface of the cutting unit, and in response to a second force that moves the swivel mechanism to the second swiveling position, the virtual pivot axis moves to a second height position which is recessed with respect to the top surface, wherein the second force is different from the first force.

8. The mounting unit as claimed in claim 7, wherein the virtual pivot axis is arranged in the vicinity of the top surface of the cutting unit facing away, when mounted, from the housing of the hair cutting appliance.

9. The mounting unit as claimed in claim 7, wherein the first swiveling position associated with the first state is a neutral position, and the at least one second swiveling position associated with the second state is an end position.

10. The mounting unit as claimed in claim 7, wherein the first height position of the virtual pivot axis and the second height position of the virtual pivot axis are offset by an overall pivot offset dimension in a range of 0.5 mm to 12.0 mm.

11. The mounting unit as claimed in claim 7, wherein the first height position of the virtual pivot axis is offset from the top surface of the cutting unit by a first pivot offset dimension in a range of 0.0 mm to +5.0 mm.

12. The mounting unit as claimed in claim 7, wherein the second height position of the virtual pivot axis is offset from the top surface of the cutting unit by a second pivot offset dimension in a range of −6.0 mm to 0.0 mm.

13. The mounting unit as claimed in claim 7, wherein a pivot angle between the first swiveling position and the second swiveling position of the cutting unit is in a range of 10° to 50°.

14. A hair cutting appliance comprising a housing accommodating a motor, a cutting unit, and a mounting unit as claimed in claim 7 for coupling the cutting unit and the housing.

15. The mounting unit of claim 7, wherein the first height position of the virtual pivot axis and the second height position of the virtual pivot axis are offset by an overall pivot offset dimension in a range of one of 1.0 mm to 6.0 mm and 1.0 mm to 2.5 mm.

16. The mounting unit of claim 7, wherein the first height position of the virtual pivot axis is offset from the top surface of the cutting unit by a first pivot offset dimension in a range of one of 0.0 mm to +2.0 mm and +0.25 mm to +0.75 mm.

17. The mounting unit of claim 7, wherein the second height position of the virtual pivot axis is offset from the top surface of the cutting unit by a second pivot offset dimension in a range of one of −4.0 mm to +0.0 mm and −2.0 mm to −1.0 mm.

18. The mounting unit of claim 7, wherein a pivot angle between the first swiveling position and the second swiveling position of the cutting unit is in range of one of 15° to 40° and 20° to 25°.

* * * * *